US009676116B2

(12) United States Patent
Dale

(10) Patent No.: US 9,676,116 B2
(45) Date of Patent: Jun. 13, 2017

(54) PIVOT RATCHETING LOG DOG

(71) Applicant: Norwood Industries Inc., Kilworthy (CA)

(72) Inventor: Peter Dale, Kilworthy (CA)

(73) Assignee: NORWOOD INDUSTRIES INC., Kilworthy, Ontario (CA)

( * ) Notice: Subject to any disclaimer, the term of this patent is extended or adjusted under 35 U.S.C. 154(b) by 847 days.

(21) Appl. No.: 14/058,816

(22) Filed: Oct. 21, 2013

(65) Prior Publication Data

US 2014/0174603 A1 Jun. 26, 2014

(30) Foreign Application Priority Data

Dec. 24, 2012 (CA) ..... 2800791

(51) Int. Cl.
*B27B 29/02* (2006.01)

(52) U.S. Cl.
CPC ..... *B27B 29/02* (2013.01)

(58) Field of Classification Search
CPC ..... B27B 5/224; B27B 5/226; B27B 5/228; B27B 5/00; B27B 5/06; B27B 5/08; B27B 5/10; B27B 5/02; B27B 5/04; B27B 29/00; B27B 29/02; B27B 29/04; B27B 29/06; B27B 29/08; B27B 29/10; B27B 31/02; B23Q 3/06; B23Q 3/183; B23Q 3/186
USPC ..... 144/250.12, 250.13, 250.15, 250.19, 144/250.2, 250.23, 250.25, 242.1
See application file for complete search history.

(56) References Cited

U.S. PATENT DOCUMENTS 2,101,192 A 12/1937 Prewitt
2,870,803 A * 1/1959 Eppler ..... B27B 1/005 144/136.1
3,695,316 A 10/1972 Pluckhahn
3,782,711 A * 1/1974 Montgomery ..... B27B 29/08 269/31
3,906,829 A * 9/1975 Westfall ..... B27B 29/10 83/435.27
3,926,086 A 12/1975 Crane
(Continued)

FOREIGN PATENT DOCUMENTS

CA 1200180 2/1986
CA 2541734 10/2007
(Continued)

OTHER PUBLICATIONS

Extended European Search Report for EP Application No. 13186932.3 dated Jan. 13, 2014.

*Primary Examiner* — Matthew G Katcoff
(74) *Attorney, Agent, or Firm* — Calfee, Halter & Griswold LLP

(57) ABSTRACT

A log dog having an elongate body that has a log dog first end, a log dog second end, a front face, a back face and side faces. A slot on the side faces extends from proximate the log dog first end to proximate the log dog second end. A row of spaced-apart teeth coupled to the body and defining setting notches adapted to enable movement of the log dog in one direction when the log dog is releasably-locked in position during operation. One or more projections can be coupled to the body proximate the log dog first end and protruding from the front face for engaging a log. Also disclosed are a log dog assembly, a log support and clamp assembly, a sawmill and a kit containing the log dog.

17 Claims, 6 Drawing Sheets

(56) References Cited

U.S. PATENT DOCUMENTS

| | | | | |
|---|---|---|---|---|
| 4,210,049 | A | 7/1980 | Gauthier | |
| 4,235,140 | A | 11/1980 | Reece | |
| 4,245,535 | A | 1/1981 | Lockwood et al. | |
| 4,275,632 | A | 6/1981 | Ross | |
| 4,300,428 | A | 11/1981 | Woodland | |
| 4,307,641 | A | 12/1981 | Shapleigh | |
| 4,640,170 | A | 2/1987 | Bakken | |
| 5,072,918 | A * | 12/1991 | Campbell | B27B 29/00 269/133 |
| 5,784,941 | A | 7/1998 | Sanborn | |
| 8,261,645 | B2 * | 9/2012 | Dale | B27B 29/08 144/242.1 |

FOREIGN PATENT DOCUMENTS

| | | | |
|---|---|---|---|
| EP | 0343870 | A1 | 11/1989 |
| FR | 1138558 | A | 6/1957 |
| GB | 2102327 | A | 2/1983 |
| WO | 9955504 | A1 | 11/1999 |

* cited by examiner

PIVOT RATCHETING LOG DOG

CROSS-REFERENCE TO RELATED APPLICATION

This application claims the benefit of and priority to Canadian Patent Application No. 2,800,791 filed Dec. 24, 2012 under the title PIVOT RATCHETING LOG DOG.

The content of the above patent application is hereby expressly incorporated by reference into the detailed description hereof.

FIELD

The specification relates to a log dog, a log dog assembly, a log support and clamp assembly having the log dog, a sawmill having the log dog and a kit containing the log dog.

BACKGROUND

One of the challenging aspects in sawmilling is the handling of the uncut logs; as the logs can be heavy and awkward. Proper sawmill operations require that the sawlog be firmly clamped into position so that it cannot move during milling. Log clamping generally requires two elements—one or more vertical log rests against which the log rests, and one or more log dogs which firmly hold and lock the log against the log rest(s). Typically locking the sawlog against the log rest(s) requires two simultaneous steps from the operator—the operator must roll the log and hold it against log rest(s) with a cant hook or other leveraging tool while, at the same time, operating the log dog(s) so as to set it and lock it in place. It can be difficult to leverage the log and then operate the log dog(s) separately because the log usually rolls backwards and therefore prevents the log dog(s) from properly binding the sawlog against the log rest(s). Thus, the operator has to perform both actions simultaneously. This requires coordination and considerable strength given that the operator leverages the sawlog (which can weigh hundreds of pounds) with one hand while the other hand operates the horizontal and vertical positioning of the log dog(s).

A number of portable sawmills having means, such as a log dog to hold a log in place, have been described in the art.

U.S. Pat. No. 5,784,941 describes a portable sawmill in which the functions of adjusting a cut and making a cut are divided between two separate devices. The invention discloses a vertical chain saw, ideally operated in an upward direction. The patent also discloses a log restraint system comprising a setwork having a headstock and a lockable L-shaped log dog, joined by a clamp which is locked with a lever.

U.S. Pat. No. 4,640,170 discloses a portable saw mill with a frame that surrounds the log. The frame is dragged or slid along a frame supporting surface. The frame holds a chain saw at the two ends of its blade, in horizontal fashion, with chain saw support members. The invention uses sliding means for facilitating the movement of the frame over the log. The log is secured against rolling using a simple jig or similar means.

U.S. Pat. No. 4,275,632 describes a portable sawmill comprising a U-shaped support or carriage, holding a band saw. When in use, a log is placed between the two guide rails and is supported in place by appropriately distanced log supports.

U.S. Pat. No. 4,307,641 describes a portable sawmill comprising two skid rails, vertical support members, a pair of guide rails. The log is held in place by two externally threaded log screw pins with pointed ends.

U.S. Pat. No. 4,300,428 describes a portable sawmill having a frame, a guide member mounted above the frame, and a carriage. The chain saw is mounted above the log, and operates at about a 45 degree angle to the horizontal. The log is held in place with log dogs which are adapted for hooking the log and holding it in position.

U.S. Pat. No. 4,235,140 describes a saw mill. The logs are held in place with a standard log dog attached to the cross members on which the log is placed.

U.S. Pat. No. 3,926,086 describes a portable saw mill that uses a complex pulley system to move the chain saw and supporting platform. When in use, a log is placed, and clamped, between the guide rails, using a set of circular discs eccentrically oriented on a rod.

U.S. Pat. No. 3,695,316 describes a portable timber milling jig that uses a carriage, holding a chain saw, axially surrounding a square guide rail. The chain saw is held at an approximately 45 degree angle and only uses one guide rail, and utilizes ball bearings on the carriage to move the carriage with respect to the guide rail. When in use, a log is placed under the guide rail, and fixed using clamping points driven into the center of the log, to which support clamps are fastened.

Canadian Patent No. 1,200,180 describes a portable saw mill comprising a frame with a guide rail and a carriage moveable along the guide rail. A band saw is supported by the carriage. The carriage is moveable along the guide rail along two sets of wheels, one engaged with the upper side of the guide rail and the other with the lower side. The log is held in place by its own weight, or by stops and a traditional locking dog.

U.S. Pat. No. 4,245,535 describes a portable sawmill with an elaborate hydraulic apparatus for cutting a log. The chain saw cuts in a vertical motion. The log is held in place using a log holding assembly having a toothed prod which grips the outer end of the log, and a cylinder which impales the inner end of the log with a ram, forcing the outer end against the prod.

U.S. Pat. No. 4,210,049 describes an "x" frame for holding a log, with a chain saw affixed to the frame in cantilever position for cutting logs crosswise. The log is held in the nook of the "x" frame.

Canadian patent application 2,541,734 to the present inventor describes a portable sawmill that is easily assembled and disassembled into portable components, and which can use generic components as its saw and/or guide rails. The log is held in place using traditional log dogs.

There is a need in the art for a log dog that permits the operator to set the log dog against the sawlog, and separately leverage the log against the log rest(s). In addition, there is a need in the art for a log dog where the height of the log dog can be adjusted. Further, there is a need in the art for a log dog that can pivot and be locked in place by a ratcheting mechanism to prevent movement of the log dog. Moreover, there is a need in the art for a log dog that can be attached to a framework that permits sliding of the log dog towards and away from the log. In addition to the above, there is a need in the art for a log dog assembly, a log support and clamp assembly having such a log dog that can assist with the handling, rolling and clamping of logs. In addition, there is a need in the art for a sawmill having such a log dog. Moreover, there is a need in the art for a kit for retrofitting a log dog to a portable sawmill that can help with log handling, rolling and clamping.

SUMMARY OF INVENTION

In one aspect, the specification discloses a log dog, containing:

an elongate body having a log dog first end, a log dog second end, a front face, a back face and side faces;

the side faces having a slot extending therethrough from proximate the log dog first end to proximate the log dog second end;

a row of spaced-apart teeth coupled to the body and defining setting notches adapted to enable movement of the log dog in one direction when the log dog is releasably-locked in position during operation; and one or more projections coupled to the body proximate the log dog first end and protruding from the front face for engaging a log.

In another aspect, the specification discloses a log dog assembly containing the log dog, as disclosed herein.

In a further aspect, the specification discloses a log support and clamp assembly containing the log dog, as disclosed herein.

In a still further aspect, the specification discloses a sawmill containing the log dog, as disclosed herein.

In another still further aspect, the specification discloses a kit containing the log dog, as disclosed herein.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

As noted above, in one aspect the specification discloses a log dog, containing:

an elongate body having a log dog first end, a log dog second end, a front face, a back face and side faces;

the side faces having a slot extending therethrough from proximate the log dog first end to proximate the log dog second end;

a row of spaced-apart teeth coupled to the body and defining setting notches adapted to enable movement of the log dog in one direction when the log dog is releasably-locked in position during operation; and one or more projections coupled to the body proximate the log dog first end and protruding from the front face for engaging a log.

Figure 1:
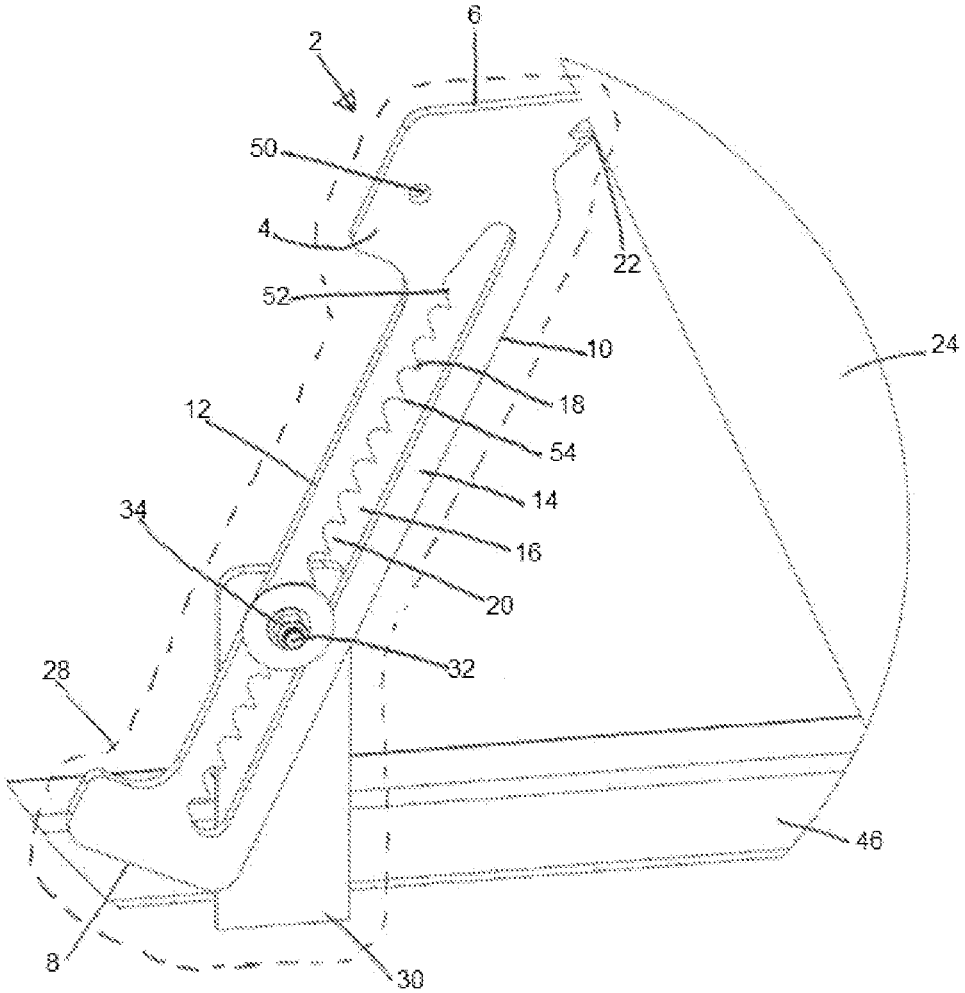
FIG. 1 shows one side of a log dog assembly in accordance with an embodiment as disclosed herein.
Figure 2:
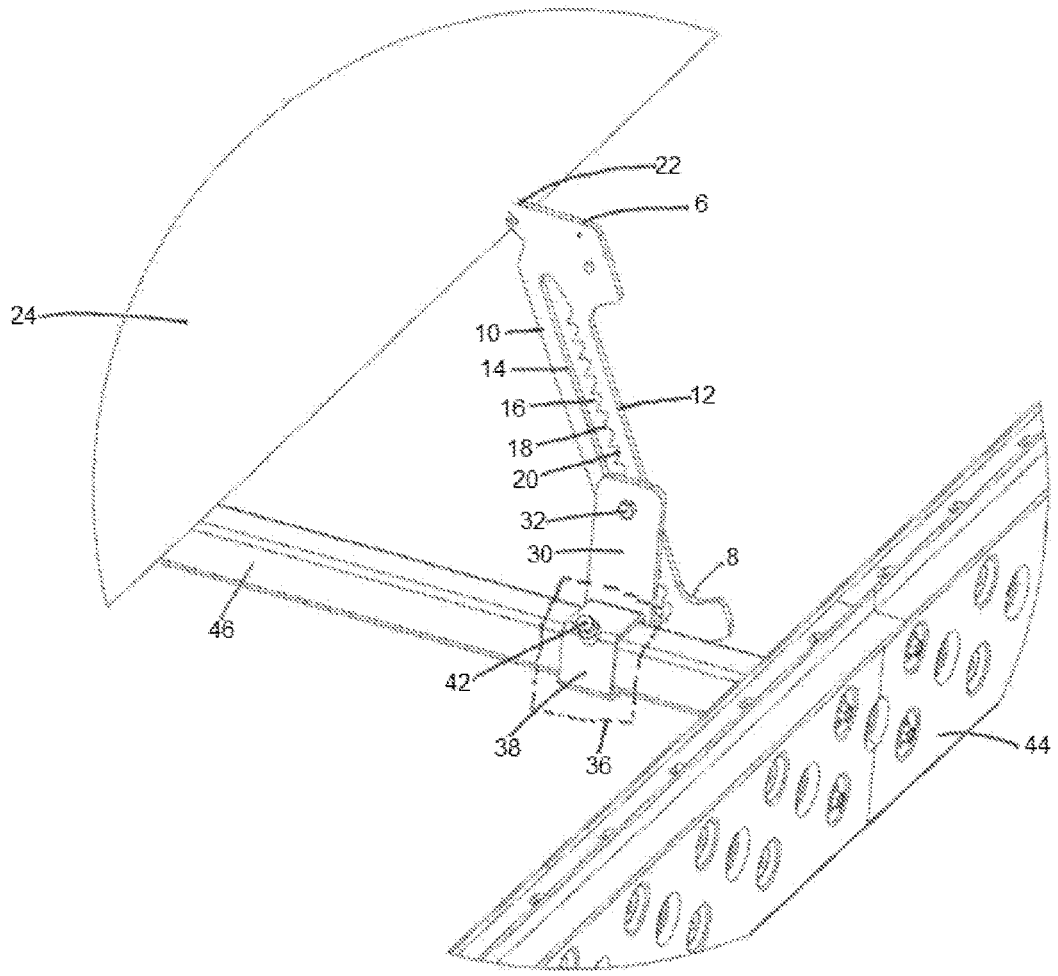
FIG. 2 shows another side of a log dog assembly in accordance with an embodiment as disclosed herein.

Referring to FIGS. 1 and 2 that disclose an embodiment of a log dog (2) and a log assembly (28), attached to a framework (44). The log dog (2) has a generally elongate body (4), which is not particularly limited. The elongate body (4) of the log dog (2) has a log dog first end (6), a log dog second end (8), a front face (10), a back face (12) and side faces (14). The log dog first end (6) is generally opposed to the log dog second end (8), and when the log dog (2) engages a log (24), the log dog first end (6) is proximate to the log (24), while the log dog second end (8) is generally distal from the log (2). In addition, when the log dog (2) engages the log (24), the front face (10) of the log dog (2) faces the log (24), while the back face (12) of the log dog (2) is opposed to the front face (10) and distal from the log (24). Further, the log dog (2) is provided with side faces (14) that extend from the front face (10) towards the back face (12).

A slot (16) can be provided on the side faces (14) of the log dog (2) that extends from one side face to the other opposing side face of the log dog (2). In other embodiments (not shown) the slot does not extend through the body of the log dog. In other embodiments (not shown), a slot is not required. In such embodiments, the teeth extend from an outer front face or back face, and the log dogs pivot is held to a pivot point located on the log dog assembly.

The shape of the slot (16) is not particularly limited, and is adapted to receive an axle (32) for coupling the log dog (2) to an assembly and for adjusting the height of the log dog (2) on a log dog assembly (28), as described further below. In the embodiment disclosed, the slot (16) extends from proximate the log dog first end (6) to the log dog second end (8), which permits sliding of the log dog (2) along the length of the slot (16), as further described herein.

As shown in FIGS. 1 and 2, the log dog (2) is provided with a row of spaced-apart teeth (18) coupled to the body (4) of the log dog (2). The shape and position of the teeth (18) are not particularly limited, as a function of the teeth (18) is to cooperate with the axle (32) to provide a ratchet-type mechanism, as further described herein. The row of teeth (18) are spaced-apart from each other, defining setting notches (20) that are engaged by the axle (32) to permit movement of log dog (2) in one direction, which involves movement of the log dog first end (6) towards the log (24). While movement of the log dog first end (6) away from the log (24) is prevented by locking of the axle (32) within the setting notches (20).

In the embodiment disclosed in the figures, the teeth (18) extend from the back face (12) towards the front face (10), however, other configurations (not shown), for instance where the teeth extend from the front face (10) towards the back face (12) can also be possible, so long as they maintain the desired function.

The teeth (18) disclosed in the embodiment have an arcuate profile. However, other shapes, such as for example and without limitation, a flat profile, are also possible. As shown in the embodiment disclosed herein (FIG. 3), the teeth (18) have a forward end (52) attached to the body (4) that is closer to the log dog front end (6). The forward end (52) of the teeth (18) extends to the point (54) of the teeth, which is closer to the log dog second end (8) than the forward end (52) of the teeth (18). Accordingly, the teeth (18) have a sloping profile, and extend from the back face (12) close to the log dog first end (6) towards the front face (10) and the log dog second end (8).

The position of the teeth (18) is also not particularly limited. In the embodiment as disclosed in the figures, the teeth (18) are positioned such that they project into the slot (16) from the back face (12) of the log dog (2). However, it is also possible to position the row of teeth (18) along one or both of the side faces (14) of the log dog (2), so long as the teeth (18) can operatively couple with the axle (32) for releasably-locking the log dog (2) in place during operation, as described further herein.

The spacing between the teeth (18) is not particularly limited, so long as they are spaced-apart enough to accommodate the axle (32), and permit the axle (32) to engage a setting notch (20), which would allow the movement of the log dog (2) in one direction and also releasably-lock the log dog (2) in position during operation.

The log dog (2) is also provided with one or more projections (22) that extend from the body (4) of the log dog (2) to engage a log (24). In the embodiments disclosed in the figures, the projections (22) are positioned close to the log dog first end (6) and protrude outwardly from the front face (10) of the log dog (2) to engage a log (24). The number of projections (22) is not particularly limited and can depend upon the specific application and design requirements. In one embodiment, for example and without limitation, and as shown in the figures, the log dog (2) has two projections (22).

Figure 5:
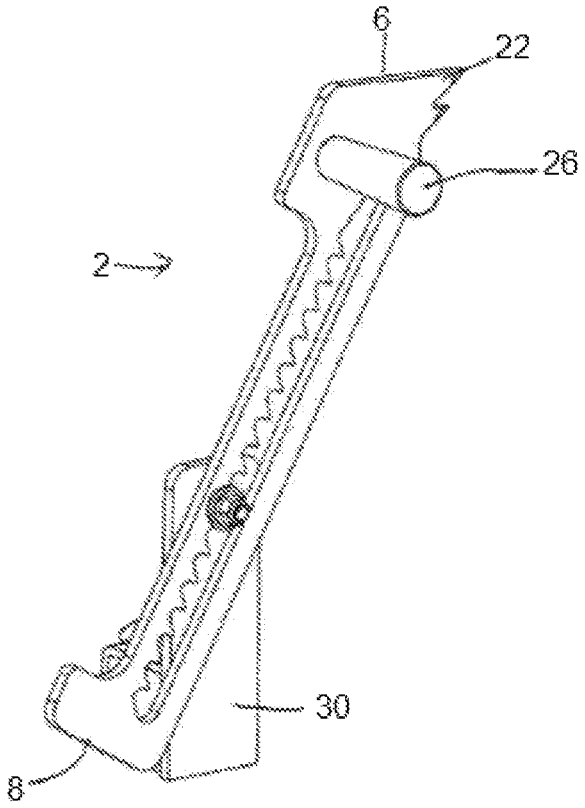
FIG. 5 shows a perspective view of the log dog assembly with a handle.

In one embodiment, as shown in FIG. 5, the log dog (2) can be provided with a handle (26) to assist with handling and maneuvering the log dog (2). The number and position of the handle (26) is not particularly limited and can depend upon the application and design requirements. In a further embodiment, as shown in the figures, the handle (26) is provided and coupled to one of the side faces of the log dog (2) and is positioned close to the first end (6) of the log dog (2). An opening (50) (FIG. 3) can be provided on the body (4) of the log dog (2), which is adapted for receiving and affixing a handle (26) by means that should be known to a person of skill in the art, such as, for example and without limitation, a bolt or nut. Alternatively, the handle can be made by fabricating it into the steel of the log dog, for example, by bending or welding.

The log dog (2) can be provided as a separate piece. Alternatively, the log dog (2) can be provided as part of a log dog assembly (28) or a kit containing components of the log dog assembly (28). In addition, the log dog (2) can also be used as part of a sawmill (58; see FIG. 6).

The log dog assembly (28) or kit contains the log dog (2), as described herein, and a log dog assembly frame (30) that has an axle (32) coupled to the frame (30). The shape and material of construction of the frame (30) is not particularly limited, so long as the log dog (2) can be attached to it and the frame (30) can be used for holding the log dog (2) and engaging the log dog (2) with a log (24). In one embodiment, as shown in the figures, the log dog assembly frame (30) is a flat piece that can be attached to a cross-member (46) of a frame-work (44) using a coupler (36), as described further herein.

The position, shape, size and material of construction of the axle (32) are also not particularly limited. In one embodiment, the axle (32) projects from the surface of the frame (30) and is normal to it. The axle (32) is adapted to engage the slot (16) of the log dog (2), by inserting the axle (32) into the slot (16), and hence is sized accordingly. In addition, the size and shape of the axle (32) is selected to allow the axle (32) to move along the length of the slot (16), and also engage the setting notches (20) for locking the log dog (2) in place during operation. The arrangement between the axle (32) and notches (20) can be adjustably secured by the use of a fastener (34) as shown in FIG. 1. Preferably, when the axle (32) is secured by the fastener (34), it remains freely movable between notches (20).

The combination of the teeth (18) with the setting notches (20), along with the axle (32) provides for a ratchet-type mechanism that allows movement of the log dog (2) in one direction, while preventing movement of the log dog (2) in opposing direction by releasably-locking the log dog (2) in position during operation. In the embodiment shown in the figures, the ratcheting-type mechanism allows movement of the log dog first end (6) towards the log (24), which results in axle (32) being positioned closer to the second end (8) of the log dog (2) than the first end (6). After extension of the log dog (2), the log dog (2) can be adjusted to allow the axle (32) to engage into the setting notches (20). The projections (22) of the log dog (2) can be pressed into a log (24). Pressures due to gravity and/or the log (24) can help to retain the axle (32) in the setting notches (20), and helps to prevent movement of first end (6) of the log dog (2) away from the log (24), which would result in the axle moving towards the first end (6) of the log (2), while at the same time locking the log dog (2) in position.

The coupling of the log dog (2) to the axle (32) is performed to allow the log dog (2) to pivot about an axis extending along the length of the axle (32). This allows the log dog (2) to be rotated about the axis of the axle (32). During use, the operator can move the log dog (2), as needed, i.e. both towards and away from the log (24). As shown in FIGS. 1 and 2, the axle (32) can be formed from, for example and without limitation, a bolt that extends through the frame (30).

Figure 3:
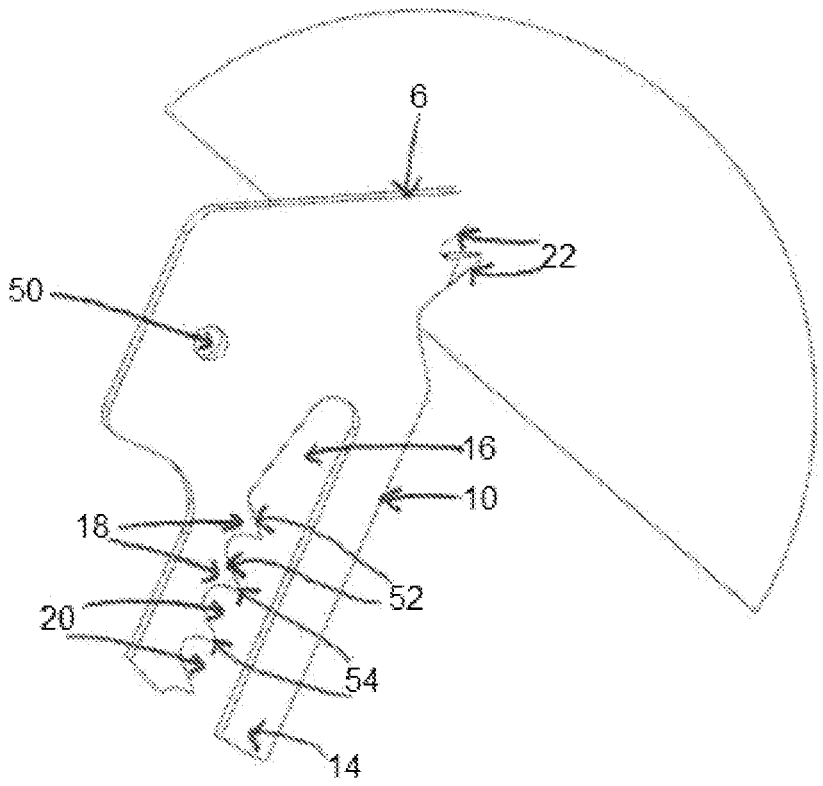
FIG. 3 shows an expanded portion of a log dog engaging a log in accordance with an embodiment as disclosed herein.
Figure 4:
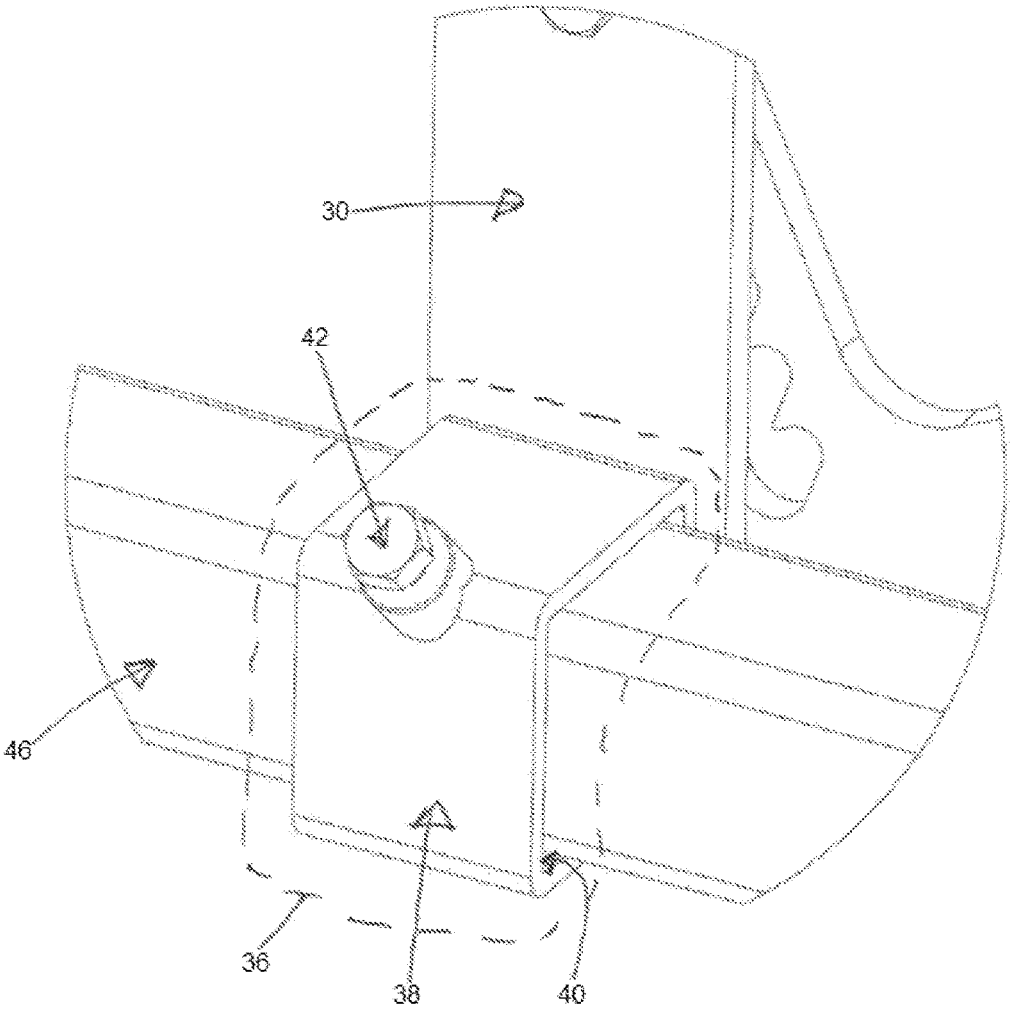
FIG. 4 shows an expanded portion of a coupler of a log dog assembly in accordance with an embodiment as disclosed herein.

As mentioned above, the log dog assembly (28) can also be provided with a coupler (36) (FIGS. 2 and 3). The shape and structure of the coupler (36) is not particularly limited and can depend upon the application and design requirements. In one embodiment as disclosed herein, the coupler (36) is formed by a housing (38) having an aperture (40), which is adapted for receiving a cross-member (46) of frame-work (44), such as a frame-work of a log support or bed (60) of a sawmill. The cross-member (46) of the frame-work (44) passes through the aperture (40) of the housing (38), which allows the log dog assembly (28) to slide along the length of the cross-member (46). To lock the coupler (36) in place, a lug (42), bolt or other fastening means can be provided. The lug (42) engages the coupler (36) and can be tightened or loosened to affix or loosen, respectively, the coupler (36) to the cross-member (46).

Figure 6:
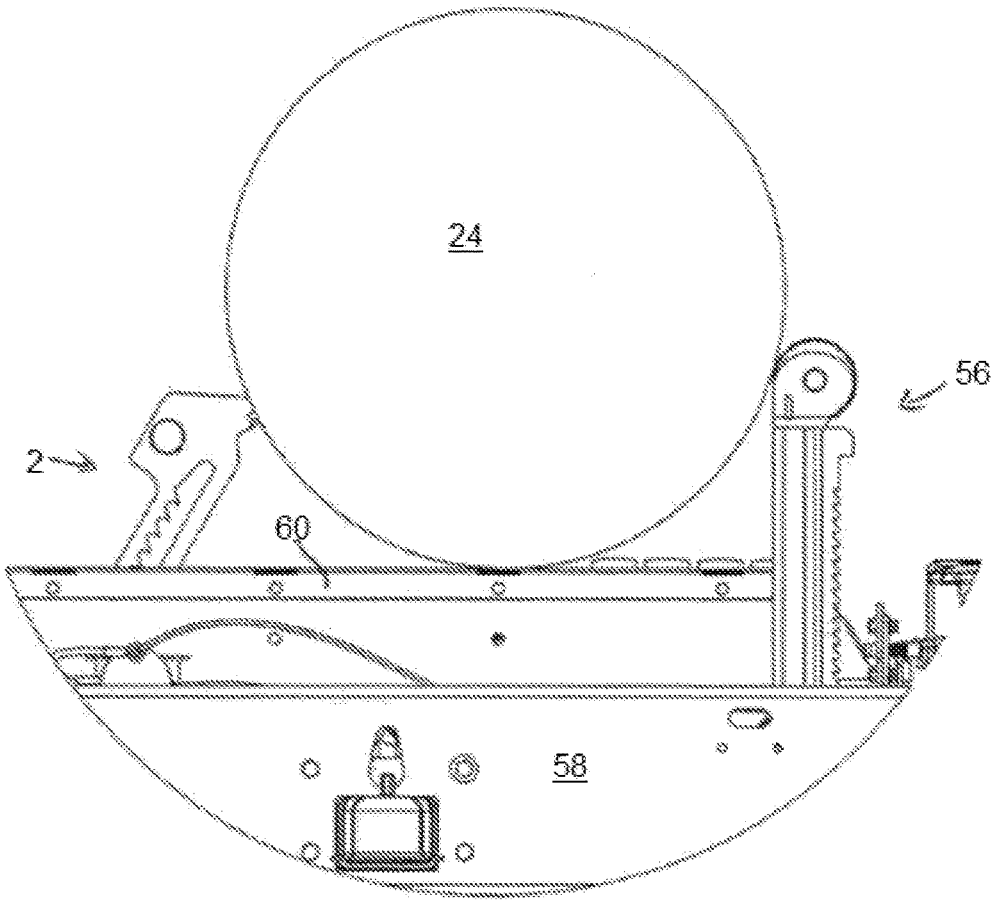
FIG. 6 shows a side view of a log dog assembly, log, log rest and sawmill bed.

The log dog (2) disclosed herein permits the operator to set the log dog (2) against the log (24), and then, leverage the log against the log rest (56), while the log dog (2) settles into a tight locking position holding the log (24) against the log rest(s)(56), shown in FIG. 6.

During operation, the ratcheting log dog assembly (28) slides along the cross-member (46) under the log (24), such that the log dog assembly (28) can be slid towards or away from the log (24) and allowed to angle down onto the log (24). For use, the operator can lift the log dog (2) to a suitable height. Due to the ratchet-type design of the teeth (18), adjustment of the log dog (2) to position the axle (32) towards the second end (8) of the log dog (2) is possible. The operator then drops the log dog (2) in such a way that the axle (32) engages a setting notch (20) of the log dog (2), and then the operator positions the projections (22) of the log dog (2) towards the log (24). Gravity helps to retain log dog (2) in position and prevent slippage of the log dog (2) due engagement of the axle (32) in the setting notch (20). Then, with both hands free, the operator leverages the log (24) with a leveraging tool against the log rest(s). As this is done, the log dog (2) projection (22) can slide further down the side of the log (24) due to gravity, while preventing the log (2)

from rolling backwards and so firmly lock the log (24) in place. The angle and height of the log dog (2) can be adjusted by sliding the coupler (36) in or out, as well as the vertical placement of the log dog (2) can be adjusted by allowing the axle (32) to slide the slot (16) of the log dog (2). Unlocking the log dog (2) can also a simple process. The operator lifts the log dog second end (8) to disengage the teeth (18) from the axle (32), and allow the axle (32) to slide towards the first end (6) of the log dog (2).

Accordingly, by the prior art methods and apparatus, the user is required to cant or otherwise leverage the log with one hand, while simultaneously adjusting (both vertically and horizontally) the log dog with one and then locking the log dog into place. By use of the present invention, the user first rests the log dog against the log. Then the user levers the log into place against the log rest (using two hands, if desired). The log dog, by operation of gravity and its pivot point falls into a tight fit with the log. This results in the positioning and locking of the log being easier and safer.

The log dog (2), log dog assembly (28) and kit can be particularly suitable for portable sawmills, and for use by hunters, "do-it-yourselfers", and people in remote areas, who need to saw boards, clapboards, shingles, etc., since it allows for a highly variable log size to be affixed to it, and can allow for a single operator to maneuver the log into place, then clamp the log in place using only one hand to operate the clamp mechanism. This allows the user to use their other hand to stabilize the log, greatly improving use and safety of a sawmill, for example, when a single person, in a remote area, is sawing logs. The assembly (28) can also allow great flexibility in the size of logs being clamped to it, thanks to the adjustable nature of the log dog (2).

In addition to the above, another benefit to this design, aside from helping the operator work his/her sawmill alone with less effort, is that it is a simple design with virtually no maintenance requirements or the possibility of failure. Further, it is economical to fabricate thanks to its simplicity.

Certain adaptations and modifications of the described embodiments can be made. Therefore, the above discussed embodiments are considered to be illustrative and not restrictive.

| Table of elements | |
|---|---|
| 2 | log dog |
| 4 | elongate body |
| 6 | log dog first end |
| 8 | log dog second end |
| 10 | front face |
| 12 | back face |
| 14 | side faces |
| 16 | slot |
| 18 | teeth |
| 20 | setting notches |
| 22 | projections |
| 24 | log |
| 26 | handle |
| 28 | log dog assembly |
| 30 | log dog assembly frame |
| 32 | axle |
| 34 | fastener |
| 36 | coupler |
| 38 | housing |
| 40 | aperture |
| 42 | lug |
| 44 | framework |
| 46 | cross-member |
| 50 | opening |
| 52 | forward end |
| 54 | point |

-continued

| Table of elements | |
|---|---|
| 56 | log rest |
| 58 | sawmill |
| 60 | bed |

What is claimed is:

1. A log dog, comprising:

an elongate body having a log dog first end, a log dog second end, a front face, a back face and side faces;

a row of spaced-apart teeth coupled to the body and defining setting notches adapted to enable movement of the log dog in one direction when the log dog is releasably-locked in position during operation; and one or more projections coupled to the body, the projections being proximate the log dog first end and protruding from the front face for engaging a log, wherein the side faces have a slot extending from proximate the log dog first end to proximate the log dog second end and wherein the teeth extend into the slot.

2. The log dog according to claim 1, wherein the teeth are inclined from the back face towards the front face.

3. The log dog according to claim 1, wherein the teeth have an arcuate profile.

4. The log dog according to claim 1, wherein the teeth slope from the back face and proximate the log dog first end to the front face and towards the log dog second end.

5. The log dog according to claim 1, wherein the slot extends through the side faces.

6. The log dog according to claim 5, further comprising a handle coupled proximate the log dog first end.

7. A log dog assembly, comprising:

a log dog assembly frame;

an axle coupled to the log dog assembly frame; and a log dog, comprising:

an elongate body having a log dog first end, a log dog second end, a front face, a back face and side faces;

a row of spaced-apart teeth coupled to the body and defining setting notches; and one or more projections coupled to the body, the projections being proximate the log dog first end and protruding from the front face for engaging a log;

wherein the side faces have a slot extending from proximate the log dog first end to proximate the log dog second end and wherein the teeth extend into the slot; and wherein the axle engages the log dog and is operatively couplable with the row of spaced-apart teeth to enable movement of the log dog in one direction when the log dog is releasably-locked in position during operation.

8. The log dog assembly according to claim 7, further comprising a fastener for fastening the axle to the log dog.

9. The log dog assembly according to claim 7, further comprising a coupler for coupling the log dog assembly to a framework.

10. The log dog assembly according to claim 9, wherein the coupler comprises:

a housing having an aperture for receiving a cross-member of the framework and permitting slidable movement of the housing along the cross-member; and a lug coupled to the housing for releasably locking the housing to the cross-member.

11. The log dog assembly according to claim 7, wherein the teeth are inclined from the back face towards the front face.

12. A log support and clamp assembly, comprising:

a framework, a log rest and an opposing log dog coupled to the framework, the log dog being slideably moveable towards the log rest;

the log dog comprising:

an elongate body having a log dog first end, a log dog second end, a front face, a back face and side faces;

a row of spaced-apart teeth coupled to the body and defining setting notches adapted to enable movement of the log dog in one direction when the log dog is releasably-locked in position during operation; and one or more projections coupled to the body, the projections being proximate the log dog first end and protruding from the front face for engaging a log;

wherein the side faces have a slot extending from proximate the log dog first end to proximate the log dog second end and wherein the teeth extend into the slot.

13. The log support and clamp assembly according to claim 12, further comprising:

a log dog assembly frame; and an axle coupled to the log dog assembly frame;

wherein the axle engages the log dog and is operatively couplable with the row of spaced-apart teeth to enable movement of the log dog in the one direction when the log dog is releasably-locked in position during operation.

14. The log support and clamp assembly according to claim 12, further comprising a fastener for fastening the axle to the log dog.

15. The log support and clamp assembly according to claim 13, further comprising a coupler attached to the log dog assembly frame for coupling the log dog assembly to the framework.

16. The log support and clamp assembly according to claim 15, wherein the coupler comprises:

a housing having an aperture for receiving a cross-member of the framework and permitting slidable movement of the housing along the cross-member; and a lug coupled to the housing for releasably locking the housing to the cross-member.

17. The log support and clamp assembly according to claim 12, wherein the teeth are inclined from the back face towards the front face.

* * * * *